United States Patent [19]

Grutsch

[11] Patent Number: 4,516,372

[45] Date of Patent: May 14, 1985

[54] CONCRETE FORMWORK

[76] Inventor: George A. Grutsch, 6455 S. Meadowwood La., Missoula, Mont. 59803

[21] Appl. No.: 515,222

[22] Filed: Jul. 20, 1983

Related U.S. Application Data

[63] Continuation of Ser. No. 293,033, Aug. 14, 1981.

[51] Int. Cl.[3] ..... E04B 2/00

[52] U.S. Cl. ..... 52/309.12; 52/426; 52/562

[58] Field of Search ..... 52/309.7, 309.8, 309.9, 52/309.11, 309.12, 562, 565, 424, 426, 428

[56] References Cited

U.S. PATENT DOCUMENTS

| | | | |
|---|---|---|---|
| 3,149,437 | 9/1964 | Wheeler | 52/309.9 |
| 3,383,817 | 5/1968 | Gregori | 52/656 |
| 3,772,842 | 11/1973 | Barbera | 52/562 |
| 3,788,020 | 1/1974 | Gregori | 52/426 |
| 4,177,617 | 12/1979 | DeLuca | 52/565 |
| 4,223,501 | 9/1980 | De Lozier | 52/426 |
| 4,336,676 | 1/1982 | Artzer | 52/309.11 |

*Primary Examiner*—Henry E. Raduazo

*Attorney, Agent, or Firm*—William D. Hall; Darle M. Short

[57] ABSTRACT

Concrete formwork is provided comprised of a plurality of panels with backing plates tied together by tie wires or metal ties. In certain embodiments of this invention the panels are comprised of a material having a high insulating ability, but having relatively poor strength capabilities. Examples of these materials are polyurethane, polystyrene, and other foam plastics. The panels are arranged in a plurality of panel assemblies wherein each panel assembly includes a pair of panels spaced horizontally and tied together. The panel assemblies are arranged one on top of the other and end to end to form a complete wall. The panels have shiplap joint edges so that the joints between the panels interlock and are not in a single plane. The panels can be easily manufactured on the site by a plastic foam producing machine and a molding machine. The backing plates and metal ties or tie wires can be molded in place when the panels are molded. The backing plates are located on the exterior faces of each pair of panel sets and in some embodiments run the entire length of the panel. The tie wires and metal ties pass through the panels and attach to the backing plates.

16 Claims, 11 Drawing Figures

CONCRETE FORMWORK

This is a continuation of application Ser. No. 293,033, filed Aug. 14, 1981.

This invention relates to concrete forms. More particularly, this invention relates to concrete forms, for forming a wall, which are comprised of a foam plastic composition and which can be left in place after the forms have been filled with concrete and the concrete has hardened.

BACKGROUND OF THE INVENTION

The most common material historically and currently used in concrete forms is wood. Recently, other alternative materials have been experimented with and used due to the limitations that wood as a material possesses. Such materials have included polyurethane and other plastics materials. Most of these prior art attempts to use and actual prior use of polyurethane and other plastics material in concrete forms involve the use of a high density plastic material having a relatively poor insulating ability rather than a low density material with excellent insulating qualities. The high density material is employed because it is stronger than the low density material. The structural arrangements of these prior art attempts and uses require that the higher strength material may be employed.

Some concrete forms using polyurethane or other plastics materials employ a low density material. However, these prior forms have involved radically new form configurations which of course radically change the configuration of the resulting walls which make the walls incompatible with most conventional building methods. The new configurations are necessary in order to use a low density polyurethane or other plastic material.

Some of these prior embodiments use preformed blocks of the high density plastic material that are manufactured off the construction site and transported thereto. These blocks are shaped very similar to conventional concrete blocks with vertical holes therethrough. To form a wall, the blocks are stacked one on top of another and the vertical holes filled with concrete.

There, of course, are many variations of the above. Some of the prior forms add panels on the exterior surfaces thereof for added structural stability and for added insulating capability. Still other prior art forms employ high density plastic panels tied directly together by metal ties to form a concrete form for receiving concrete and forming a concrete wall.

However, none of the prior art forms and form arrangements provide a form assembly which can employ a low density-high insulating ability foam plastic material that is compatible with most conventional building materials and methods. In all the formwork using foam plastic material known in the prior art, the foam plastic material that comprises the foam blocks or panels is either (1) comprised of a high density material (that has a low insulating ability) to withstand the forces involved in the pouring of the concrete therein and to have a strength necessary to support the forces exerted on the wall by the completed structure itself and the form work is in a conventional configuration; or (2) is comprised of a low density material but the forms are of a non-conventional configuration that is incompatible with most conventional building materials and methods.

In view of the above, it is clear that there exists a need in the art for a concrete formwork assembly which can be comprised of a material having a high insulating ability while at the same time possessing the strength qualities necessary to withstand the forces of concrete placement and hardening therein and subsequent structural load, without failure, and which is compatible with all conventional building materials and methods. It is the purpose of this invention to fulfill this need along with other needs apparent to those skilled in the art based on the following disclosure:

SUMMARY OF THE INVENTION

In general this invention provides concrete formwork comprising a panel assembly including at least one pair of panels, said pair of panels being spaced horizontally, backing plates which are placed against each exterior face of said panels, and structural tieing means for tieing said backing plates together, said tieing means extending between and being connected to said backing plates, wherein said panels are comprised of a plastic material.

Due to this configuration of elements, in some embodiments of this invention, a low density plastic foam having a high insulating ability (such as polyurethane) can be used to form the panels. The panels can be left in place after the concrete placed within has hardened and become a part of the finished wall. In other embodiments of this invention, the panels are all of the same size and shape, and all the edges of the panels are shiplap joint edges.

In still other embodiments of this invention the backing plates are two long strips of metal which are equal in length to the exterior surfaces of the panels but have a width substantially less than the width of the panels. These backing plates are arranged such that each exterior face of each panel has two backing plates abutting thereto, one at the top edge and one at the bottom edge thereof. The backing plates may be positioned in indents in the exterior panels and may have lips which extend over the top and bottom edges of the exterior panels.

This invention has many advantages over the prior art concrete formwork. One advantage is that a plastic foam material can be employed as the material which the panels comprising this formwork are made of. The additional advantages set forth below are based on the assumption that these panels are comprised of a foam plastic material. Some of the following additional advantages are advantages that all plastic foam forms have over wooden forms; however, most of these advantages are unique to the invention.

First, minimal structural material would need to be transported to the job site in the practice of this invention. The plastic form panels could be manufactured right on the job site by a plastic foam making machine and a molding machine. The ingredients that comprise the plastic foam would be transported to the site in a state (i.e, liquid and/or powder) such that the bulk of the raw materials would be much less than the finished panels. The only finished products that would have to be transported to the job site would be the backing plates and the tieing members.

Another advantage of this invention is that the forms according to this invention need not include any lumber, nor is lumber necessary to manufacture the plastic foam panels. This advantage should result in a cost savings to the user.

Yet another advantage of this invention is that there is no need to strip the forms after the concrete is hardened. This results in a savings in labor costs. Also, no additional labor time and money is necessary to install insulation since the forms become the insulation for the wall after the concrete has hardened.

Furthermore, no furring strips need be added to the wall for attaching interior and exterior wall coverings thereto since these coverings can be attached to the backing plates that are a part of the embodiments of this invention. A full width concrete wall compatible with conventional building structural interfaces is produced. For example, if it is desired to build a structure with a concrete wood construction, a row of backing plates can be removed exposing a bearing surface for the attachment of ledgers or girders thereto.

A further advantage of this invention is that the end product is stronger and more durable than a concrete block wall and no mortar is needed as with the construction of a concrete block wall.

It is also an advantage of this invention that the insulating value of a finished wall according to this invention can be as high as twice that of a conventional 2×4 glass-filled wall. In addition to increasing the insulating ability of the finished wall, this relatively high insulating characteristic also allows concrete to be poured in colder weather that with known forms without the application of external heat since the forms are self-insulating. The outside layer of insulation will also deter spalling of the concrete due to freeze-thaw action when the wall is completed.

A further advantage of this invention is that the joints between the interior panels are offset from the joints between the exterior panels such that leakage of concrete is greatly deterred.

Yet another advantage of this invention is that due to the completely open spaces between the sets of panels, there are little limitations on placing reinforcing steel and electrical, plumbing and other fixtures within the area to be filled with concrete. Furthermore, since the wall is full dimensional width at all locations, inserts, anchor bolts, joists, etc., can be embedeed at any point in the wall without weakening the structure.

It is also an advantage of this invention that the end product (the completed wall) has a very good insulating ability without sacrificing strength, prohibits air flow, has good workability and fire rating.

A further advantage of this invention over the prior art plastic material forms is that no shear planes or other weak points or lines are present in the wall after the concrete has hardened, such as are characteristic of the majority of the prior art.

This invention will now be described with respect to the Figures, wherein:

In the drawings

DETAILED DESCRIPTION OF THE DRAWINGS

Figure 1:
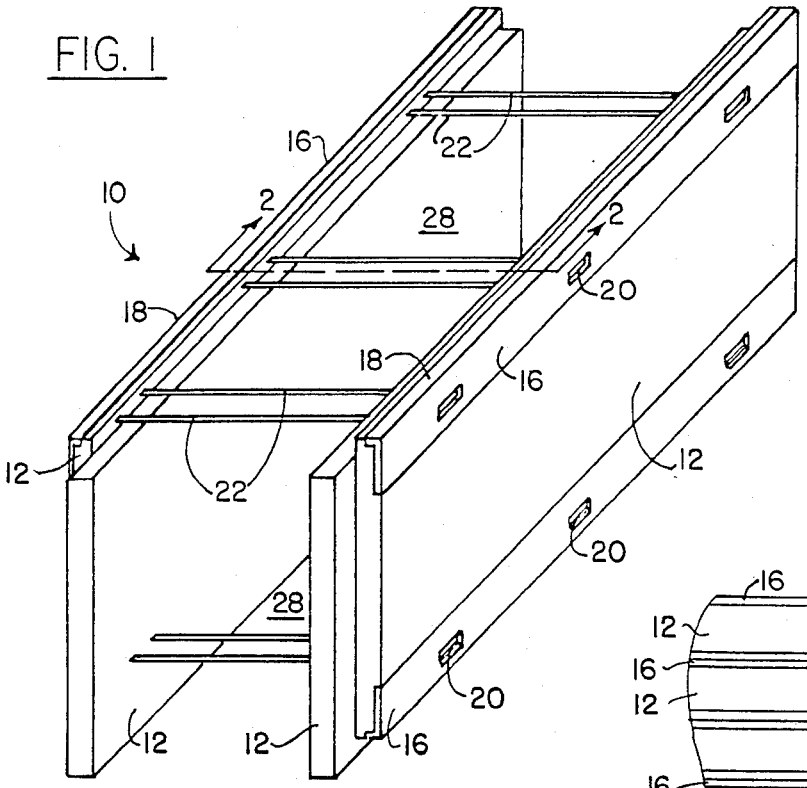
FIG. 1 is an isometric view of one embodiment of a panel assembly according to this invention.
Figure 2:
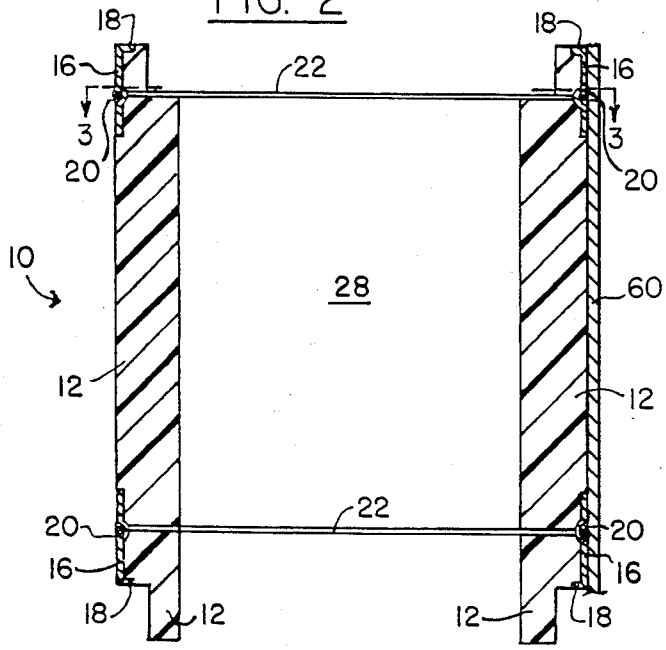
FIG. 2 is a cross-sectional view of the panel assembly illustrated in FIG. 1 taken along line 2—2 of FIG. 1.
Figure 3:
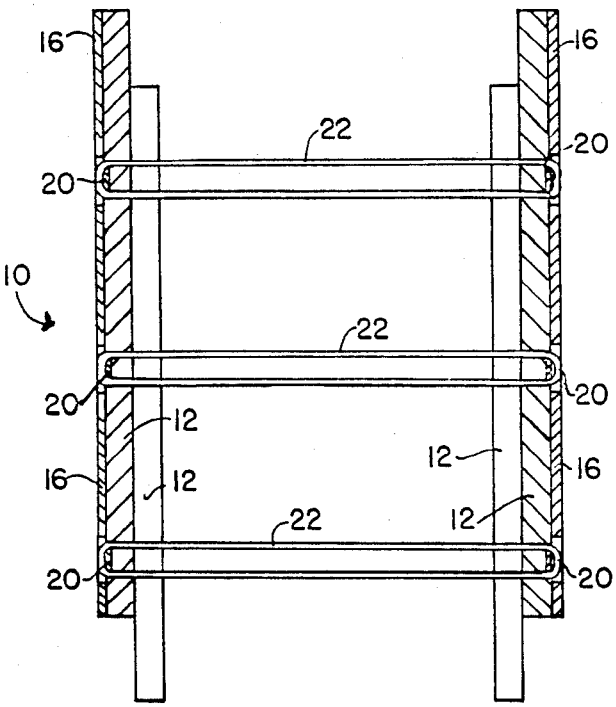
FIG. 3 is a cross-sectional view of the panel assembly illustrated in FIGS. 1 and 2 taken along line 3—3 of FIG. 2.

Referring to the Figures, and in particular FIGS. 1-3, one embodiment of this invention is illustrated comprising a panel assembly 10 consisting of panels 12, backing plates 16 and tie wires 22. Panels 12 are comprised of a low density foam plastic mixture which can be poured into forms right at the job site. The mixture can be transported to the job site in a low bulk form such as a liquid or a powder. The mixture would then have to be transformed into the foam state at the job site and injected or poured into the forms provided to shape panels 12. This foam plastic mixture will be later described in more detail.

Panels 12 are single panels with ordinary shiplap joint edges on all four edges thereof. In some embodiments of this invention, panels 12 are formed and molded with tie wires 22 and backing plates 16 in place. Space 28 is defined by opposing panels 12 spaced horizontally apart. Panels 12 have shiplap joint edges so that the joints between adjacent panels 12 are not in one plane and are interlocking. This provides for a stronger structure and also reduces the possibility of concrete leaking thru the joints when the panel assembly 10 is being filled with concrete and while the concrete is hardening.

Figure 4:
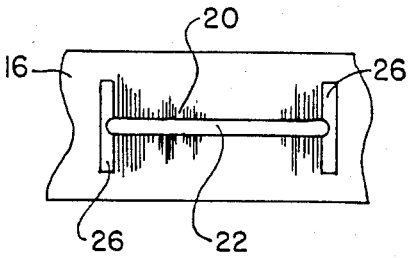
FIG. 4 is a partial side plan view of a backing plate that can be employed with the panel assemblies illustrated in FIGS. 1-3.

Located abutting the exterior surface of panels 12, along the top and bottom edges thereof, are backing plates 16. In some embodiments (as in the Figures), the exterior surfaces of panels 12 may be molded with indentations therein to receive backing plates 16 so that a smooth exterior surface is maintained. Backing plates 16 are comprised of metal and have lips 18 that extend over the top and bottom edges, respectively, of the exterior surfaces of panels 12. Backing plates 16 extend the entire length of the exterior surfaces of panels 12 and have semicircular sections 20 punched inward therein at spaced horizontal intervals to which tie wires 22 are attached. When the semicircular sections 20 are punched into backing plates 16, slots 26 (exaggerated in FIG. 4 for clarity) are formed between the edges of semicircular sections 20 and the rest of backing plates 16 as shown in FIG. 4. Tie wires 22 are attached to backing plates 16 by threading one end of tie wire 22 through a vertical slot 26, passing it behind semicircular section 20 and threading the tie wire 14 back out through the other vertical slot 26.

Therefore, in summary, panel assembly 10 is comprised of a spaced pair of matching panels 12 reinforced by backing panels 16 which are tied together by tie wires 22.

Another embodiment of the panel assembly 10 includes backing plates 32 and metal ties 38 instead of backing plates 16 and tie wires 22, respectively (see FIGS. 6-10). Backing plates 32 are the same as backing plates 16, and are located in the same position, except that instead of semicircular sections 20 being punched therein. slotted sections 36 are punched therein at spaced horizontal intervals along backing plates 32.

Slotted sections 36 are punched into backing plates 32 such that horizontal slots 44 (exaggerated in FIG. 10 for clarity) are formed between slotted section 36 and the rest of backing plate 32. Also formed by this punching action is flat section 45 of slotted section 36 which is parallel to, but offset inward from backing plate 32.

Figure 9:
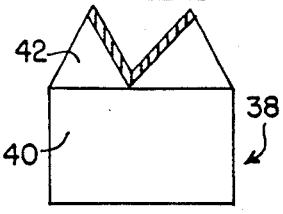
FIG. 9 is a sectional view of the metal tie illustrated in FIGS. 6-8 taken along line 9—9 of FIG. 8.

Metal ties 38 have end portions 40 which are rectangular plates. The portion of metal tie 38 that extends between the end portions 40 varies in cross-section from a flat horizontal cross-section immediately adjacent end panels 40 to a V cross-section in the center thereof (as illustrated by FIG. 9), forming ridges 42.

To assemble the metal ties 38 and the backing plates 34 of this embodiment, the metal ties 38 are attached to the backing plates 34 by inserting the respective end panels 40 into the top slots 44 such that end portions 40 are positioned behind and abut flat portions 45.

Figure 11:
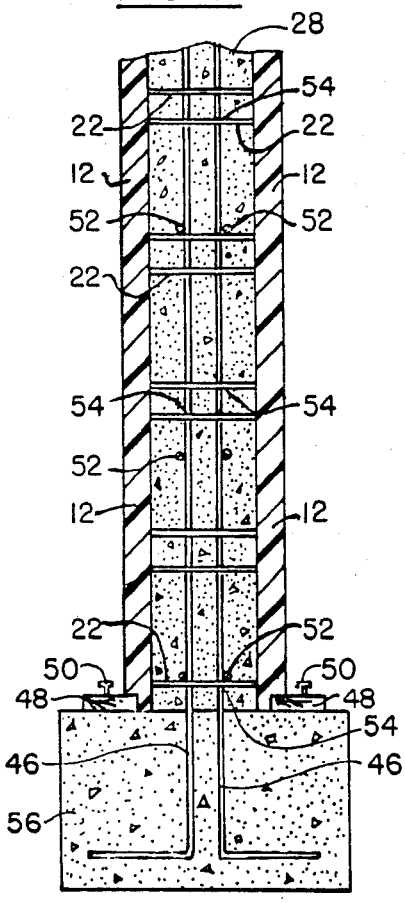
FIG. 11 illustrates one embodiment of a typical installation embodying this invention.
Figure 6:
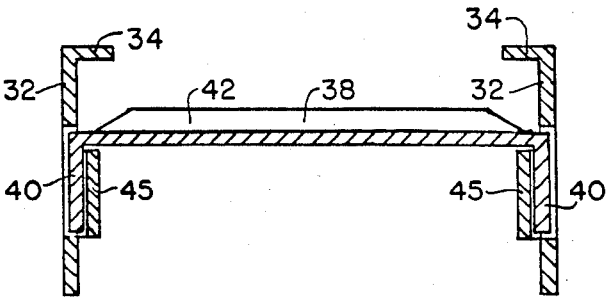
FIG. 6 is a side sectional view of a second metal tie and backing plate assembly that can be employed in the practice of this invention.
Figure 10:
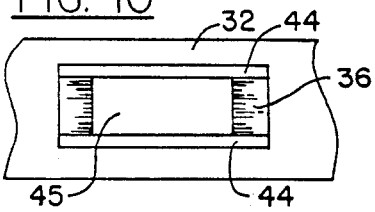
FIG. 10 is a partial side view of the backing plate illustrated in FIG. 6.
Figure 7:
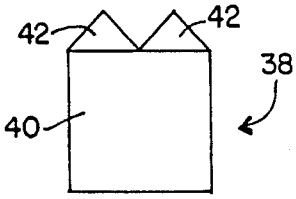
FIG. 7 is an end view of the metal tie illustrated in FIG. 6.
Figure 8:
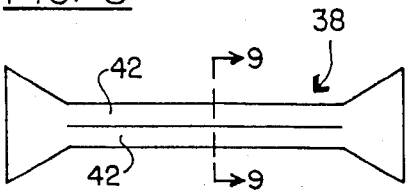
FIG. 8 is a top view of the metal tie illustrated in FIGS. 6 and 7.

FIG. 11 illustrates a wall constructed on a previously poured concrete base 56 using a plurality of panel assemblies 10. The wall is formed by taking numerous panel assemblies 10, as described above, and placing them one on top of the other and edge-to-edge on concrete base 56 until a complete wall is formed. The lower edge of the bottom panel 12 rests on wood cleats 48 which are in turn fastened to concrete base 56 by concrete nails 50. The purpose of using wood cletes 48 is, of course, to stabilize the wall being constructed both in a horizontal and vertical direction and to help keep the wall plumb during the pouring of concrete.

In the embodiment illustrated in FIG. 11, vertical reinforcing bars 46 are anchored in concrete base 56 and extend upward in the space 28 in panel assembly 10. Vertical reinforcing bars 46 are tied to tie wires 22 at junctions 54 whenever the two intersect. Additional reinforcing can be added consisting of horizontal reinforcing bars 52. After the panel assemblies 10 have been installed in place, and the desired reinforcing installed within space 28, wall form is ready for the receipt of concrete. The concrete is poured into space 28 until space 28 is full. When the concrete hardens, a unitary wall, possessing many advantages over walls currently being constructed as described above, is formed.

Figure 5:
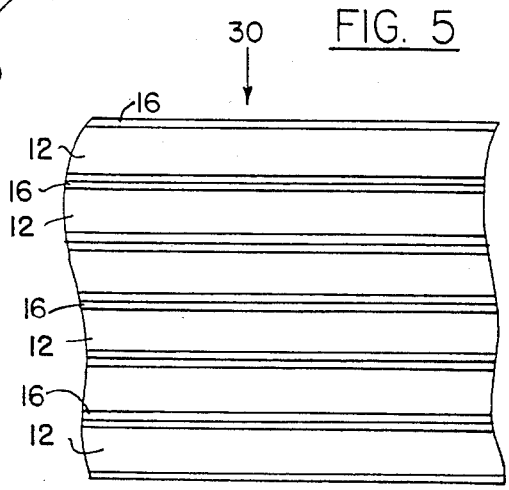
FIG. 5 is a side plan view of a wall constructed of panel assemblies as illustrated in FIGS. 1-3.

FIG. 5 illustrates how the wall will look from either the interior or exterior when the wall is complete. Wall 30 is comprised of rows of panels 12 and backing plates 16 stacked one on top of the other. Almost all types of known interior or exterior wall coverings, such as wall covering 60 (see FIG. 2), can be attached to wall 30. For example, for a wood or sheetrock interface with wall 30, self-taping screws can be screwed to backing plates 16. The screws will then adhere the wood or sheetrock to the backing plates when the wood or sheetrock is pressed against the same. For a plaster or stucco wall covering, the top portions of the top backing plates 16 and the lower portions of bottom backing plates 16 can be bent out at a right angle to wall 30 to help secure the respective wall covering to wall 30.

One advantage of this invention discussed above is that the finished wall is compatible to interface with currently used building materials and methods including joists.

One method of attaching a joist to wall 30 is as follows. First, an anchor bolt and joist hanger would have to be embedded in wall 30 when wall 30 is poured. Then, portions of panels 12 would have to be cut and removed from the area adjacent the anchor bolt and joist hanger. Lastly, the joist would be attached to the joist hanger, directly abutting the concrete in space 28.

The reinforcing materials and techniques compatible with this invention are not limited to that illustrated in FIG. 11 and discussed above. Due to the fact that space 28 is free of obstructions in the practice of this invention, almost any type and configuration of reinforcing can be employed in space 28.

The arrangement of elements as described above enables one to use a low density plastic foam to form panels 12. The lower the density of the foam, the greater the insulating ability of the panels comprised of the foam. The ingredients that make up the foam can be transported to the job site in a low bulk state (i.e., liquid and/or powder). Thus, if a plastic foam making machine and a panel molding machine are provided at the job site, the panels can be manufactured right on the site, saving transportation costs due to the difference in bulk between the raw materials and the finished product. In addition, as noted above, the backing plates and ties can be molded in place when the forms are molded.

In one preferred embodiment, the plastic foam material is a polyurethane. Polyurethanes that can be employed are those manufactured by Insta-Foam Products, Inc., and Witco Chemical possessing the following properties:

| | |
|---|---|
| Density | 1.5–3.5 PCF |
| Compressive Strength | 16–20 PSI |
| Tensile Strength | 20–25 PSI |
| Flexural Strength | 40–45 PSI |
| K-Factor | .15–.17 BTU/HR/°F./Ft$^2$/IN |
| Water Vapor Transmission | 2.0 Perms/IN |

These polyurethane foams are formed by entrapping the carbon dioxide which is released during the course of the polymerization reaction within the polyurethane.

In other embodiments of this invention other suitable foams consisting of polymeric materials may be employed instead of a polyurethane foam, such as polystyrene foam.

Once given the above disclosure, many other features, modifications and improvements will become apparent to the skilled artisan. Such other features, modifications, and improvements are, therefore, considered a part of this invention, the scope of which is to be determined by the following claims:

I claim:

1. Permanent formwork for forming a concrete wall, wherein said formwork becomes part of the finished wall, said formwork comprising:

a panel assembly including at least first and second panels, said panels being spaced apart horizontally in a parallel relationship, each of said panels having an interior and an exterior surface, said panel assembly including means for stacking said panel assembly on another similar panel assembly, first and second backing plates, said first backing plate abutting the exterior surface of said first panel, said second backing plate abutting the exterior surface of said second panel, and said first and second backing plates lying entirely on the exteriors of said panels, structural tieing means for tieing said first and second backing plates together, said tieing means being separate and distinct from said backing plates, said tieing means extending through the panels between and being connected to said first and second backing plates to restrain outward movement of said panels, wherein a number of said panel assemblies are stacked end-to-end and vertically to form said formwork, said tieing means of adjacent said panel assemblies being spaced apart when said panel assemblies are stacked, wherein said panels are comprised of a moldable plastic foam material which is relatively soft and weak, as compared to the material of which said plates are composed, said panel assemblies being sufficiently strong so that a stack of said panel assemblies is self-supporting during the pouring of the concrete therein, said panels, plates and tieing means comprising means for becoming a part of the finished wall.

2. Permanent formwork according to claim 1 wherein said interior and exterior surfaces are flat.

3. Permanent formwork according to claim 2 wherein said backing plates are metallic.

4. Permanent formwork according to claim 3 wherein said backing plates are elongated plates extending the length of said panels but having a width less than $\frac{1}{2}$ of the width of said panels.

5. Permanent formwork according to claim 1 wherein the plastic foam material has a density of 1.5–3.5 PCF.

6. Permanent formwork according to claim 5 wherein said plastic foam material is a low density foam plastic material.

7. Permanent formwork according to claim 1 wherein said backing plates are in the shape of plates having a continuous thin thickness relative to the width and length of said plates.

8. Permanent formwork according to claim 7 further comprising third and fourth backing plates identical to the first and second backing plates, said third backing plate abutting the exterior surface of said first panel, said fourth backing plate abutting the exterior surface of the second panel, said third and fourth backing plates being spaced from said first and second backing plates, respectively, said third and fourth backing plates being tied together.

9. Permanent formwork according to claim 8 wherein said backing plates extend the length of said panels.

10. Permanent formwork according to claim 9 wherein said backing plates are located adjacent the longitudinal edges of the exterior surfaces of the panels.

11. Permanent formwork according to claim 1 wherein said backing plates are horizontally positioned.

12. Permanent formwork according to claim 8 wherein when the panel assemblies are arranged end-to-end, the first, second, third and fourth backing plates are in alignment and form continuous members.

13. Permanent formwork according to claim 1 wherein the tieing means includes a wire extending between and looped through the backing plates.

14. A concrete wall comprising:

a concrete portion and a series of forms which were employed for holding the concrete during the period of time during which the concrete was poured and was cured, each said form comprising a pair of parallel and spaced vertical panels composed of molded plastic material, each such panel having a backing plate of a material that is relatively strong as compared to the molded plastic and is capable of having a substantial load secured thereto, said backing plates abutting the exterior surface of each panel and holding means passing directly through the wall and interconnecting said plates to prevent outward horizontal movement of said plates and of said panels, said forms being stacked one above the other to provide an upwardly extending elongated cavity, said concrete filling said cavity and securely holding said backing plates in position as a part of the finished permanent wall so that loads may be attached to said backing plates;

said plates, panels, holding means and concrete all being permanent parts of said permanent wall, and wall covering attached to said backing plates.

15. A permanent concrete wall as defined in claim 14 in which said backing plates are elongated metallic plates positioned on each of said forms so that the plate of each form is an extension of the plates on adjacent forms to thereby provide a larger plate extending along the wall to provide a convenient means for attaching loads to the wall over an area at least partly covering a series of forms.

16. Permanent formwork according to claim 15 wherein each of said panels has two backing plates abutting its exterior surface when said formwork is constructed.

* * * * *

UNITED STATES PATENT AND TRADEMARK OFFICE

CERTIFICATE OF CORRECTION

PATENT NO. : B1 4,516,372
DATED : April 25, 2000
INVENTOR(S) : George A. Grutsch It is certified that error appears in the above-identified patent and that said Letters Patent is hereby corrected as shown below:

Title page,
Item [56], FOREIGN PATENT DOCUMENTS, add the following:
-- 2,265,944 10/24/75 France --

Signed and Sealed this

Second Day of September, 2003

JAMES E. ROGAN
*Director of the United States Patent and Trademark Office*

US004516372B1

REEXAMINATION CERTIFICATE (4050th)

United States Patent [19]

Grutsch

[11] B1 4,516,372

[45] Certificate Issued Apr. 25, 2000

[54] CONCRETE FORMWORK

[75] Inventor: George A. Grutsch, Missoula, Mont.

[73] Assignee: CIU Corporation, Missouli, Mont.

Reexamination Requests:
No. 90/004,627, May 9, 1997
No. 90/004,673, Jun. 4, 1997

Reexamination Certificate for:

| | |
|---|---|
| Patent No.: | **4,516,372** |
| Issued: | **May 14, 1985** |
| Appl. No.: | **06/515,222** |
| Filed: | **Jul. 20, 1983** |

Related U.S. Application Data

[63] Continuation of application No. 06/293,033, Aug. 14, 1981.

[51] Int. Cl.[7] ..... E04B 2/00; E04B 2/86

[52] U.S. Cl. ..... 52/309.12; 52/309.15; 52/309.17; 52/422; 52/426; 52/562; 52/565

[58] Field of Search ..... 52/309.15, 309.17, 52/565, 422

[56] References Cited

U.S. PATENT DOCUMENTS

| | | |
|---|---|---|
| 1,033,461 | 7/1912 | Peterson . |
| 1,914,770 | 6/1933 | Duncan . |
| 2,185,335 | 1/1940 | Fischer . |
| 2,535,277 | 12/1950 | Fama . |
| 3,149,437 | 9/1964 | Wheeler-Nicholson . |
| 3,383,817 | 5/1968 | Gregori . |
| 3,410,044 | 11/1968 | Moog . |
| 3,552,076 | 1/1971 | Gregori . |
| 3,767,158 | 10/1973 | Mikus . |
| 3,772,842 | 11/1973 | Barbera . |
| 3,778,949 | 12/1973 | Hellerich . |
| 3,782,049 | 1/1974 | Sachs . |
| 3,788,020 | 1/1974 | Gregori . |
| 3,800,015 | 3/1974 | Sachs . |
| 4,116,415 | 9/1978 | Ward . |
| 4,177,617 | 12/1979 | DeLuca et al. . |
| 4,223,501 | 9/1980 | DeLozier . |
| 4,336,676 | 6/1982 | Artzer . |

FOREIGN PATENT DOCUMENTS

| | | |
|---|---|---|
| 2111730 | 12/1972 | Germany . |
| 2255810 | 5/1974 | Germany . |

OTHER PUBLICATIONS

*McGraw Hill Dictionary of Scientific and Technical Terms* 2nd ed. (McGraw–Hill, Inc., 1978).

*Primary Examiner*—Michael Safavi

[57] ABSTRACT

Concrete formwork is provided comprised of a plurality of panels with backing plates tied together by tie wires or metal ties. In certain embodiments of this invention the panels are comprised of a material having a high insulating ability, but having relatively poor strength capabilities. Examples of these materials are polyurethane, polystyrene, and other foam plastics. The panels are arranged in a plurality of panel assemblies wherein each panel assembly includes a pair of panels spaced horizontally and tied together. The panel assemblies are arranged one on top of the other and end to end to form a complete wall. The panels have shiplap joint edges so that the joints between the panels interlock and are not in a single plane. The panels can be easily manufactured on the site by a plastic foam producing machine and a molding machine. The backing plates and metal ties or tie wires can be molded in place when the panels are molded. The backing plates are located on the exterior faces of each pair of panel sets and in some embodiments run the entire length of the panel. The tie wires and metal ties pass through the panels and attach to the backing plates.

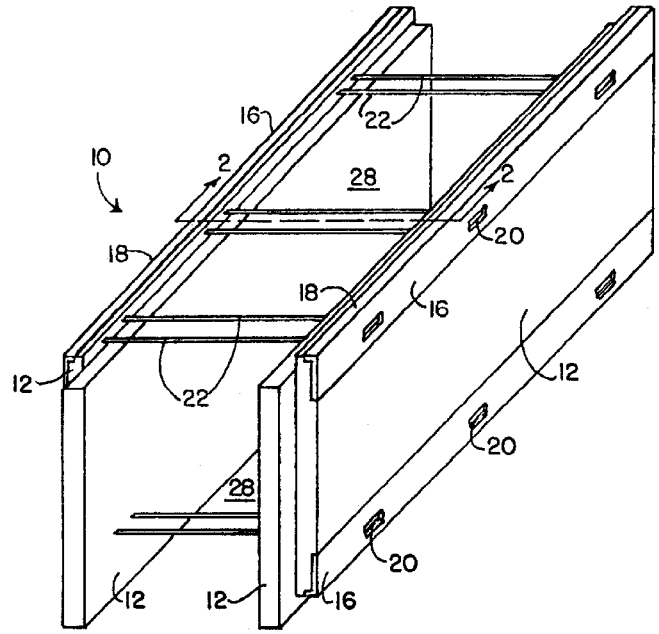

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 15 and 16 is confirmed.

Claims 1–14 are cancelled.

New claims 17–23 are added and determined to be patentable.

*17. A concrete wall as defined in claim 14 in which said stacked forms have horizontal joints between them, and*

*at least one of the backing plates on each form extending adjacent to at least a portion of at least one of said horizontal joints to pervent outward movement of said portion.*

*18. A concrete wall as defined in claim 17 wherein said backing plates extend closely adjacent to a portion of a horizontal joint.*

*19. A concrete wall as defined in claim 18, in which at least two adjacent ones of said forms have mating shiplap joints.*

*20. A concrete wall as defined in claim 14 in which said concrete portion has an interior side and an exterior side,*

*at least some of said forms having one of its panels abutting said exterior side and one of its backing plates abutting the panel that abuts said exterior side,*

*one of said molded plastic panels being on the exterior side of the wall and comprises insulation that will deter spalling of the concrete due to freeze thaw action of the completed wall.*

*21. A concrete wall as defined in claim 14, in which a backing plate on a given form is positioned below a backing plate of the form above the given form and sufficiently close thereto to receive a substantial part of the vertical forces applied by the form above the given form.*

*22. A concrete wall as defined in claim 21, in which said molded plastic has a density not greater than 3.5 PCF.*

*23. A concrete wall as defined in claim 22, in which said holding means comprises a one-piece member extending all the way from one backing plate on one of the panels of one of said forms to a backing plate on the other panel of said form.*

* * * * *